US005143141A

United States Patent [19]

Frulla

[11] Patent Number: 5,143,141

[45] Date of Patent: Sep. 1, 1992

[54] PROCESS AND APPARATUS FOR THE CONTROLLED-PRESSURE CASTING OF MOLTEN METALS

[75] Inventor: Claudio Frulla, Busto Arsizio, Italy

[73] Assignee: TVA Holding S.p.A., Busto Arsizio, Italy

[21] Appl. No.: 564,276

[22] Filed: Aug. 8, 1990

[30] Foreign Application Priority Data

Aug. 24, 1989 [IT] Italy ..... 21546 A/89

[51] Int. Cl.[5] ..... B22D 18/02

[52] U.S. Cl. ..... 164/120; 164/319; 164/320; 164/321; 164/342; 164/344

[58] Field of Search ..... 164/120, 113, 136, 319, 164/320, 321, 342, 344

[56] References Cited

U.S. PATENT DOCUMENTS 2,500,556 3/1950 Mallach ..... 164/120
3,664,410 5/1972 Groteke ..... 164/120 X

FOREIGN PATENT DOCUMENTS 0318655 6/1989 European Pat. Off. .
2504424 10/1982 France .
56-68575 6/1981 Japan .
58-65561 4/1983 Japan .
60-46856 3/1985 Japan .
980146 1/1965 United Kingdom ..... 164/120

*Primary Examiner*—J. Reed Batten, Jr.
*Attorney, Agent, or Firm*—Guido Modiano; Albert Josif

[57] ABSTRACT

Controlled-pressure casting of molten metals using a die with an extractable punch and a fixed die, includes positioning and stopping the punch within the die so as to define a casting cavity with a volume greater that that of the part to be obtained. A metered amount of liquid metal is then poured into the casting cavity through a duct which leads into the cavity, and the punch is moved to close inside the die so as to create a pressure suitable for distributing the metal throughout the cavity. A high-pressure compression is then exerted on the metal contained in the cavity and, maintained until the molten metal solidifies, the punch is partially removed from the die, with separation of the punch from the formed part, before finally removing the punch from the die and extracting the part from the die.

18 Claims, 2 Drawing Sheets

PROCESS AND APPARATUS FOR THE CONTROLLED-PRESSURE CASTING OF MOLTEN METALS

BACKGROUND OF THE INVENTION

The present invention relates to a process and apparatus for the controlled-pressure casting of molten metals, particularly light alloys of aluminum and magnesium.

Various methods are already known for the casting of bodies molded in molten metal, and in particular in light alloys, within openable metal dies The most common casting processes entail gravity feeding into the closed dies and the creation of the required pressure by means of well-known feedheads, the function whereof is to feed the molten casting of liquid metal by increasing the hydrostatic load on the liquid metal and thus to prevent the formation of cavities and porosities inside the casting during shrinkage in the solidification step.

Another method for casting bodies molded in molten metal is so-called low-pressure casting, which substantially consists in placing the die or mould over a closed furnace connected by means of a tube to the casting cavity defined in the die and in then exerting a pressure on the surface of the metal contained in the furnace so that the liquid metal rises through the tube and feeds the die. The pressure required for casting is maintained for a preset time.

In some casting devices which operate at low pressure, the casting cavity is connected to a source of pressurized gas, generally air, which partially contrasts the pressure exerted on the free surface of the metal in the furnace.

Known methods which provide casting under pressure, especially for light alloys, comprise pressure die-casting, according to which the liquid metal is injected into the die at high pressure; centrifugal casting, according to which the die or dies are subjected to rapid rotation during the casting; and the most recent method, known as "squeeze casting", according to which a given amount of liquid metal is fed into a part of the die and is then compressed by the punch subjected to high pressure.

These casting methods are chosen and used according to the shape and dimensions of the parts to be obtained and according to the alloy to be cast, but in practice they are not always capable of leading to cast bodies which are free from structural defects, such as the presence of internal tensions, micro-porosities and non-uniform compactness during production, which derive mainly from lack of control in the step of solidification of the part.

In particular, for the casting of bodies made of aluminum or magnesium alloy with a complex configuration and with variable-thickness parts, such as light-alloy wheels for motor vehicles and the like, a process for pressure-casting into an openable die, which is capable of providing castings with better mechanical characteristics with respect to those which can be obtained with known methods, in short times and therefore with lower costs, has already been proposed in the European patent application No. 88115342.3 filed on Sep. 19, 1988. The sequence of the steps of execution of this casting process provides: the feeding of the liquid metal, by means of a feedhead or the like, into a casting cavity with an inlet arranged laterally to said cavity and into a distribution chamber which is connected to said casting cavity and is arranged below it, then the completion of the filling of said casting cavity by means of pressure exerted on the metal in said cavity and in said distribution chamber, and then the compression of the solidifying metal by means of a high pressure exerted by the upper part of said casting cavity and from below, if required, by the fixed die. The separation of the components of the die and the extraction of the solidified casting are finally performed.

In practice, this casting process with lateral feeding of the casting cavity entails significant constructive complexity, which is due most of all to the necessary deviations and branchings of the feed duct in order to provide the most complete possible filling of all the regions of the casting cavity. The presence of a lateral feeding channel shaped so as to send the molten metal simultaneously into the casting cavity and into the underlying distribution chamber in fact necessarily entails different values of the filling rate of the various regions of the casting cavity and therefore a distribution of metal which is not always uniform, with consequent values of mechanical resistance of the formed casting which are not always uniformly distributed.

Finally, parts obtained with said process have an insufficient degree of surface finish, so that it is indispensable to perform further finishing operations and remove the protruding stalk or peduncle constituted by the metal which has solidified inside the end of the feedhead and has remained rigidly associated with the formed casting.

SUMMARY OF THE INVENTION

The aim of the present invention is therefore to provide a process for the casting of molten metals and in particular of metallic alloys of aluminum and magnesium, capable of obtaining formed castings with mechanical and surface characteristics which are significantly better than those which can be obtained with known pressure-casting methods and most of all with much lower costs and times, significantly reducing the operations for the finishing of the obtained castings.

Another object of the invention is to provide a pressure-casting process which is conceived so as to allow, in any case and even with very complicated casting cavities, such as for example those for the obtainment of motor vehicle wheels, the uniform and homogeneous filling of all the regions of the casting cavity and the obtainment of castings with a smooth and regular surface.

A further object of the invention is to provide a pressure-casting apparatus which can perform said process, which has such a structure as to be constructively simpler and easier to operate than known casting devices, and which provides formed bodies with regular and accurate geometric dimensions.

Not least object of the invention is to provide a casting process and a related apparatus capable of facilitating the separation of the part from the die or mould during opening, thus eliminating the need to coat or treat the casting cavity to avoid said disadvantage.

This aim, these objects and others which will become apparent hereinafter are achieved by a process for the controlled pressure-casting of molten metals, particularly light alloys of aluminum and magnesium, using an extractable punch and a fixed die, characterized in that it comprises the steps of:

placing and stopping said punch of the die within said fixed die so as to define a casting cavity with a volume greater than that of the part to be obtained;

pouring a metered amount of liquid metal into said casting cavity through at least one duct which leads into said cavity;

moving said punch to close inside said die so as to create a pressure suitable for distributing the metal in all of the cavity;

exerting a high-pressure compression on the metal contained in said cavity, maintaining said pressure until the molten metal solidifies;

partially removing said punch from said die with separation from the formed part;

finally removing said punch from said die and extracting the part from said die.

For the practical execution of said casting process, an apparatus is provided which uses a die-holder structure, an openable die with a casting cavity defined by a movable punch which is insertable into a die and control means for the movement of said punch, characterized in that it comprises a fixed structure which supports said die and a structure which is movable with respect to the fixed one and with which said punch is associated, said punch being centrally provided with a duct which is connected to said casting cavity, inside which first means for compressing the liquid metal fed into said casting cavity are slidably and sealingly mounted, said first compression means being controllably activatable to exert a high compression on the metal in said casting cavity with said punch closed on said die, first and second means being finally provided for the translatory motion of said punch, in both directions and with preset strokes, so as to provide in sequence an initial partial closure of the die, then the total closure thereof after the feeding of the molten metal, and finally the lifting of the punch to allow the extraction of the part after solidification.

BRIEF DESCRIPTION OF THE DRAWINGS

Further characteristics and advantages of the present invention will become apparent from the following description of a preferred but not exclusive practical embodiment thereof, given with reference to the accompanying drawings, which are provided only by way of non-limitative example and wherein.

DESCRIPTION OF THE PREFERRED EMBODIMENTS

Figure 1:
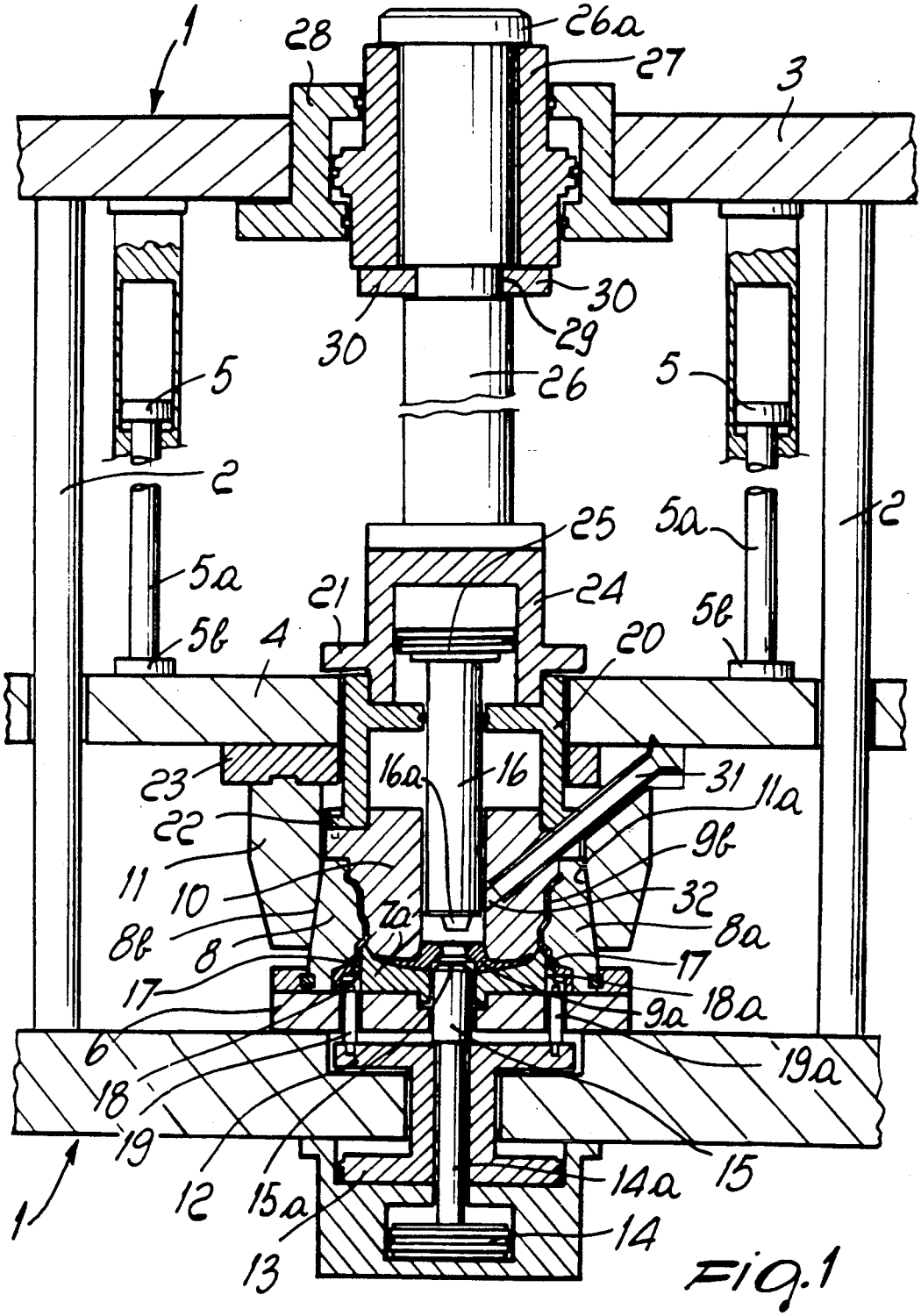
FIG. 1 is a lateral elevation view of a median cross section of a casting apparatus suitable for executing the process according to the invention, wherein the die is of the type with divaricating side walls for the casting of motor vehicle wheels and is shown in closed position.

With reference to the above figures, the illustrated apparatus uses, by way of example, a die with openable side walls suitable for the casting of a wheel of a motor vehicle, i.e. of a part made of aluminum or magnesium or alloys thereof which has a complex geometrical configuration with variable thickness.

The apparatus is in any case suitable for casting within dies of any shape and dimensions, since the casting process according to the present invention provides a particular sequence of operating steps and conditions in which the type of die or mould used is irrelevant.

The illustrated apparatus is substantially constituted by a fixed supporting structure 1, peripherally to which cylindrical columns 2 are anchored and support, at their upper end, a rigid framework 3.

Between the supporting structure 1 and the upper framework 3, a movable framework 4 is mounted so as to be able to move freely vertically along the columns 2 and can perform strokes of preset extent by means of groups of double-action plungers 5 which are slidable within cylinders anchored to the fixed upper framework 3; each stem **5*a* of the plungers 5 has its end 5*b* rigidly associated with the movable framework 4**.

A horizontal plate 6 is anchored to the fixed supporting structure 1, and a part of the fixed die, more precisely the central part **7*a* thereof, is fixed thereon. Said die is peripherally closed by two or more movable side walls or half-shells 8–8*a* of a known type, which have such an inner profile as to create, together with the punch, as will be described in greater detail hereinafter, the peripheral region 9*b* of the central casting cavity 9*a*. The casting cavity is thus formed by the central portion 7*a* and by the lateral cavity regions 9*b*. The movable half-shells 8–8*a* can be divaricated with respect to the punch and to the central part 7*a*** of the fixed die by means of pressurized-fluid horizontal plungers of the type already used in the known art which therefore are not illustrated in detail.

The outer surface **8*b* of the two half-shells 8–8*a* is substantially conical, with the smaller base arranged upward, so as to engage in a correspondingly conical seat 11*a* defined in an annular body 11 which is rigidly associated with the movable framework 4; the function of the annular body 11** is to prevent the opening of the half-shells during the step of compression of the metal inside the casting cavity.

A horizontal plate 12 is furthermore associated with the fixed supporting structure 1 and is reciprocatingly movable with respect to the fixed part **7*a* of the die by means of a lower double-action plunger 13; said plate 12 and the related plunger 13 are traversed by the stem 14*a* of a further double-action plunger 14, and the stem 14*a* is sealingly slidable within a seat which perpendicularly traverses the horizontal plate 6 and the central part 7*a* of the die and ends with a body 15 which has the end 15*a*** shaped appropriately and directed toward the punch.

An annular chamber 17 is defined around the central part **7*a* of the fixed die, between said central part and a lower portion of the half-shells 8–8*a*, and is directly connected to the lateral regions 9*b* of the cavity. Presser bodies 18, 18*a* etc. are slidably and sealingly arranged inside the chamber 17 and are fixed to the upper end of cylindrical bodies 19, 19*a* etc. which are in turn fixed to the plate 12 which is actuated by the double-action plunger 13, and are slidable within the plate 6**.

The function of the pressers 18, **18*a* etc. is to compress the metal inside the casting cavity during the solidification step, and to cause the extraction of the part from the die when the half-shells 8–8*a*** are opened at the end of the casting process.

As mentioned, the punch 10 is mounted so as to be vertically movable coaxially to the half-shells **8–8*a* by means of a frame 20 which is slidably mounted, with a preset stroke defined by appropriate flanges 21, respectively 22, which are intended to abut and stop against the upper face of the movable framework 4 and against a lower plate 23** during the step of opening and closing motion of the machine.

A duct 40 is defined centrally to the punch 10, which is connected, in a downward position, to the casting cavity and accommodates, in a vertically slidable manner, a stem 16 of a double-action plunger 25 which is accommodated inside a cylinder 24 which is rigidly associated with the frame 20 and is intended to actuate the stem 16 along the duct 40. As can be clearly seen in FIG. 1, the lower end 16*a* of the stem 16 is arranged facing the end 15*a* of the body 15. A shaft 26 is mounted above the cylinder 24, and its upper part is slidable within a double-action plunger 27 which is movable within a cylinder 28 which is rigidly associated with the upper fixed framework 3.

The upper end of the shaft 26 ends with a head 26*a* for abutment against said plunger 27. An annular groove 29 (FIG. 2) is furthermore provided transversely to said shaft 26, and bolts 30, mounted so as to be movable toward and away from said groove, can be inserted therein transversely to said shaft. The insertion of the bolts is possible only when the head 26*a* of the shaft 26 is in contact with the upper surface 27*a* of the piston 27; after said insertion the upper plunger 27 can push the shaft 26, the frame 20 and the punch 10 downward with a movement which is allowed by its stroke inside the cylinder 28.

A passage 31 is finally provided in the body of the punch 10 for the feeding of the molten metal and leads into the duct 40 inside which the stem 16 of the compression plunger 25 slides; the outlet end 32 of said passage is cutoff by said stem 16 after the feeding of the liquid metal into the casting cavity, as will become apparent hereinafter.

From what has been described it is evident that the feeding of a metered amount of liquid metal in order to obtain a motor vehicle wheel, as illustrated only by way of example in the figures, is performed at the center of the die with distribution of said metal within the central cavity of the fixed die 7*a*, from which the metal, with the aid of the punch 10, can completely fill the entire casting cavity and in particular the peripheral region 9*b*.

The particular programming with known means of the interventions of the various pistons and pressers distributed in the above described apparatus allows to provide the complete and uniform filling of all of the casting cavity and therefore to obtain a solidified part according to the casting process which is the subject of the present invention.

Therefore, bearing in mind FIGS. 1 and 2, the operation of the described apparatus can be summarized as follows.

Figure 2:
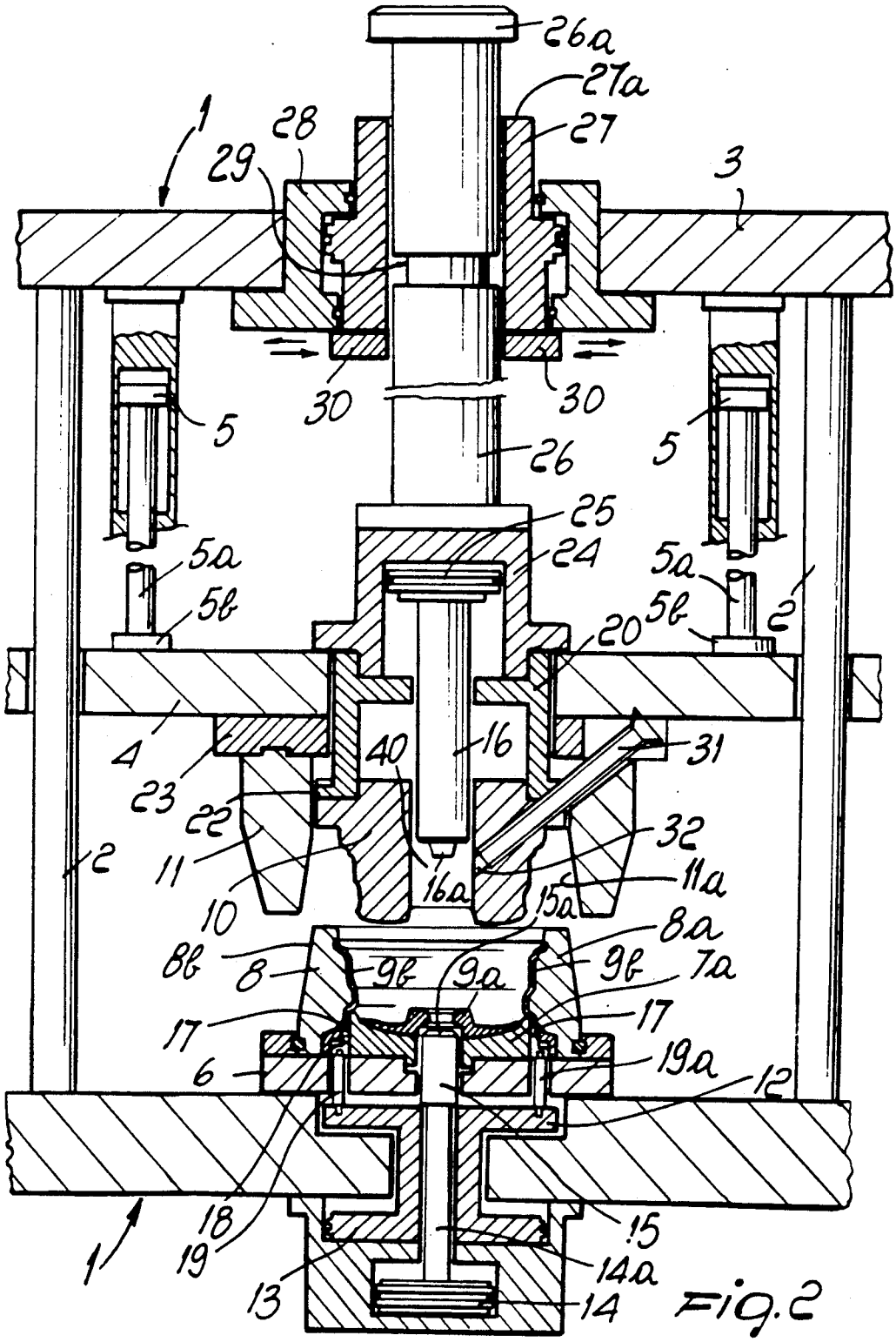
FIG. 2 is an also median sectional view of the apparatus of FIG. 1 with the die in open position with the side walls still closed.

Starting from the position in which the die is open, as illustrated in FIG. 2, wherein the movable framework 4 is kept raised by the plungers 5, the plunger 27 is also raised to its upper stroke limit due to the pressurized fluid fed into the lower chamber of the cylinder 28, the shaft 26 is moved to its upper stroke limit and the bolts 30 are extracted, one proceeds by closing the half-shells 8–8*a* by means of the outer transverse plungers, then the lateral plungers 5 are actuated so as to lower the movable framework 4 until the punch 10 is moved into the half-shells 8–8*a* and the annular body 11 is closed onto the half-shells 8–8*a*. During the downward stroke of the framework 4, the punch 10 is stopped prior to its complete closure on the die by the abutment of the head 26*a* of the shaft 26 against the upper plunger 27. Therefore said punch 10 remains raised with respect to its closure position by a preset amount.

The bolts 30 are then inserted in the groove 29 so as to mutually rigidly associate, in their downward translatory motion, the upper plunger 27 with the shaft, 26, which is rigidly associated with the punch 10.

A metered amount of liquid metal is then poured into the central region of the casting cavity, introducing it through the feeding passage 31, and then, by means of the plunger 25, the stem is lowered so as to close the outlet opening 32 of the feeding passage 31.

The upper plunger 27 is then actuated with a downward stroke so as to completely close the punch within the die and thus define the actual casting cavity; the lowering of the piston 27 forces the liquid metal present in the central region of the casting cavity to expand uniformly in the entire casting cavity, including the lateral regions 9*b*, without being able to return into the feeding passage 31.

It should be noted that the movement of the stem 16 which causes the closure of the feeding passage 31 is performed by feeding the cylinder 24 with fluid at low pressure, so that during the step of closure of the punch into the die, any excess liquid metal can rise along the passage 40, even moving upward the stem 16 and overcoming the pressure exerted on said stem 16.

The plunger 14, the plunger 13 and the plunger 25 are then actuated at high pressure; in this manner the stem 16 and the upper end 15*a* of the stem 14*a* exert a high compression in the central region of the metal contained in the casting cavity, whereas a high pressure is also exerted on the metal from the bottom upward by the peripheral pressers 19–19*a* etc. Said high compression is maintained until the part solidifies.

Said pressures are advantageously exerted according to a preset rule as a function of the temperature of the metal in the casting cavity; in particular, the maximum pressure occurs after solidification has occurred.

After solidification has occurred, one acts on the upper plunger 27 so as to be able to separate the punch from the formed part, whereas the stem 16 is kept, by means of the action of the piston 25, pressed against the part so as to avoid deformations of said part during the lifting of the punch 10.

At this point, by means of the actuation of the plungers 5 and of the plunger 25, the lifting of the die and of the stem 16 is completed until the movable part is returned to the position illustrated in FIG. 2.

When the punch is extracted and stopped out of the die, the lateral plungers intervene to open the half-shells 8–8*a*, moving them laterally to the fixed die.

Finally, in order to extract the formed part, the plunger 14 and the pressers 19–19*a* are caused to intervene, and by rising exert an action which separates the part from the casting cavity, said action, by intervening on various points which are distributed both peripherally and at the center of the part, facilitating separation without causing deformations of said part.

In practice it has been observed that the particular sequence of operating steps of the process according to the invention, which can be executed with a casting apparatus of the type described and illustrated in the figures, allows to obtain a product with mechanical and surface characteristics which are uniform in the entire part and cannot be achieved with the processes of the known art, together with the advantage that the parts obtained are such as to require no final finishing operations.

A further advantage, which derives from the use of the pressers in the die, is that it is possible to exert on the part a high pressure which is distributed on a plurality of points according to the configuration of the part.

It has furthermore been observed that the process according to the invention reduces the solidification time of the part with respect to known processes.

In the practical embodiment of the invention it is obviously possible to perform structurally and functionally equivalent modifications and variations to the process and to the apparatus without thereby abandoning the scope of the protection of the present invention.

I claim:

1. Process for the controlled pressure-casting of molten metal, comprising the steps of:

providing an extractable punch and a fixed die;

positioning said punch within said die whereby to define between said punch and said die, a casting cavity, providing at least one duct leading into said casting cavity;

providing a metered amount of molten metal;

pouring said metered amount of molten metal into said casting cavity through said at least one duct;

moving said punch inside said die whereby to create a pressure sufficient to distribute said metered amount of molten metal throughout said casting cavity;

exerting a compression force on said metered amount of metal contained in said casting cavity;

maintaining said compression force until said metered amount of molten metal solidifies completely, whereby to produce a formed part located on said die in said casting cavity;

separating said formed part from said casting cavity by moving said punch away from said die;

removing said punch from said die, and;

extracting said formed part from said die.

2. Process according to claim 1, further comprising the step of rigidly associating said formed part with said die during said step of separating said formed part from said casting cavity by partially spacing said punch from said die.

3. Process according to claim 1, further comprising the step of providing a region for accommodating excess metal during the step of moving said punch to close inside said die.

4. Process according to claim 1, wherein said step of positioning said punch within said die produces said casting cavity between said punch and said die, said casting cavity having a central region, wherein the step of providing at least one duct leading into said casting cavity includes providing said duct leading into said central region of said casting cavity, and wherein said step of pouring a metered amount of molten metal into said casting cavity through said at least one duct includes pouring said metered amount of molten metal through said duct into said central region of said cavity.

5. Process according to claim 1, further comprising the step of providing first compression means which are movable in said punch towards said die, and;

wherein said step of maintaining said compression force until said metered amount of molten metal completely solidifies produces a formed part having a central part region.

6. Process according to claim 5, further comprising the steps of;

providing second compression means surrounding said central part region, and;

moving said second compression means parallel to said punch for exerting said compression force on said metered amount of metal contained in said casting cavity.

7. Process according to claim 5, further comprising the step of pressing said formed part onto said die by moving said first compression means in said punch towards said die, whereby to rigidly associate said formed part with said die during said step of separating said formed part from said casting cavity by partially spacing said punch from said die.

8. Process according to claim 6, wherein said step of extracting said formed part from said die includes moving said second compression means parallel to said punch to act on said formed part.

9. Apparatus for the controlled pressure-casting of molten metal, comprising at least one die;

a fixed structure supporting said die;

a movable structure which is movable with respect to said fixed structure;

a movable punch connected to said movable structure and being insertable into said die;

control means for activating said movable punch, a casting cavity defined between said movable punch and said die;

at least one duct provided in said movable structure and communicating with said casting cavity;

first means for compressing molten metal fed into said casting cavity through said at least one duct, said first compression means being slidably and sealingly mounted in said movable structure and controllably activatable to compress metal in said casting cavity with said punch inserted into said die, and first and second actuation means for moving said punch in at least two directions with preset strokes, said actuation means including;

means for moving said punch to a position whereat said die is partially closed before introduction of molten metal into said casting cavity through said duct, means for further moving said punch to totally close said die after feeding molten metal into said casting cavity, and;

means for lifting said punch to allow extraction of solidified cast metal from said casting cavity.

10. Apparatus according to claim 9, wherein said first means for compressing molten metal within said casting cavity comprise;

at least one chamber provided in said movable structure;

a double-action plunger device movable in said chamber, and;

at least one stem defined by said double-action plunger device, said stem being movable along said duct for compressing molten metal contained in said casting cavity.

11. Apparatus according to claim 10, wherein said double-action plunger device is selectively and controllably feedable with pressurized fluid.

12. Apparatus according to claim 10, further comprising at least one passage communicating with said duct for feeding molten metal into said casting cavity, said stem of the double-action plunger device controllably closing said passage.

13. Apparatus according to claim 9, wherein said casting cavity has defined therein, a region affected by said first compression means, said apparatus further comprising second compression means, said second compression means being slidably movable in said die parallel to said punch and being positioned to compress molten metal contained in said casting cavity at least in a region thereof surrounding said region affected by said first compression means.

14. Apparatus according to claim 9, further comprising means for extracting said solidified cast metal from said die.

15. Apparatus according to claim 14, wherein said means for extracting said solidified cast metal from said die are constituted by said second compression means, said second compression means being activatable when said die is open.

16. Apparatus according to claim 9, further comprising means for retaining said solidified cast metal in said die when moving said punch away from said die.

17. Apparatus according to claim 16, wherein said means for retaining said solidified cast metal in said die are constituted by said first compression means, said first compression means being activatable to press said solidified cast metal against said die when moving said punch away from said die.

18. Apparatus according to claim 9, wherein said die comprises at least one pair of mutually associable side walls, wherein said side walls define at least one portion of said die, and wherein said movable structure has an annular body, said annular body being located above said die and engageable with said side walls to secure said side walls in a closed condition upon said side walls being mutually closed together to effect closure of said die.

* * * * *